US008454215B2

(12) United States Patent
Bollmann

(10) Patent No.: US 8,454,215 B2
(45) Date of Patent: Jun. 4, 2013

(54) METHOD AND LED APPARATUS FOR BILLBOARD LIGHTING

(75) Inventor: Klaus Bollmann, Horseshoe Bay, TX (US)

(73) Assignee: Ringdale, Inc., Georgetown, TX (US)

( * ) Notice: Subject to any disclaimer, the term of this patent is extended or adjusted under 35 U.S.C. 154(b) by 286 days.

(21) Appl. No.: 12/837,213

(22) Filed: Jul. 15, 2010

(65) Prior Publication Data

US 2011/0188235 A1 Aug. 4, 2011

Related U.S. Application Data

(60) Provisional application No. 61/225,629, filed on Jul. 15, 2009.

(51) Int. Cl.
*F21V 7/00* (2006.01)
*F21L 4/08* (2006.01)
*G09F 13/02* (2006.01)

(52) U.S. Cl.
USPC ..... 362/547; 362/183; 362/235

(58) Field of Classification Search
CPC ..... H01L 25/0753; H01I 2021/00; G02F 1/133605; G02F 1/133604
USPC ..... 362/218, 227, 547; 315/112.113; 40/559
See application file for complete search history.

(56) References Cited

U.S. PATENT DOCUMENTS

| | | | | |
|---|---|---|---|---|
| 3,834,822 | A * | 9/1974 | Stapleton et al. | 356/431 |
| 4,520,435 | A * | 5/1985 | Baldwin | 362/311.04 |
| 4,954,935 | A * | 9/1990 | Hammond et al. | 362/245 |
| 6,482,336 | B2 * | 11/2002 | Savant | 264/1.1 |
| 6,483,613 | B1 * | 11/2002 | Woodgate et al. | 359/19 |
| 7,170,480 | B2 * | 1/2007 | Boldt et al. | 345/83 |
| 7,883,253 | B2 * | 2/2011 | Wang | 362/613 |
| 2004/0239243 | A1 * | 12/2004 | Roberts et al. | 313/512 |
| 2008/0186737 | A1 * | 8/2008 | Awai et al. | 362/617 |
| 2010/0072499 | A1 * | 3/2010 | Kwon et al. | 257/98 |

* cited by examiner

*Primary Examiner* — Tracie Y Green
(74) *Attorney, Agent, or Firm* — Hulsey, P.C.; Christina Saenz; Loren T. Smith

(57) ABSTRACT

A high efficiency LED billboard lighting system with four LED modules replacing existing lighting modules. Each module has six heat sink assemblies arranged in two rows. The heat sink assemblies comprise an LED package mounted on a heat sink reflector. The LED package has a flat fine diffusing lens positioned over the diode. A diffusing lens is spaced apart from the heat sink assemblies. An LED controller is provided for each module, with power factor corrected, switch mode Power Supply, where the secondary side can be connected directly to a battery to monitor and charge one or more battery, and can run directly from the battery.

20 Claims, 5 Drawing Sheets

METHOD AND LED APPARATUS FOR BILLBOARD LIGHTING

RELATED APPLICATIONS

This application is related to U.S. Provisional Patent Application No. 61/225,629 filed by applicant on Jul. 15, 2009, and claims priority from that application.

BACKGROUND

1. Introduction

LED lighting for billboards offers significant maintenance savings as compared to conventional high intensity lights. When properly controlled, LED lighting has a much greater service life than conventional lamps, and LED lighting does not have the intensity degradation of conventional lamps which may lose about 30% intensity in the first 3 months of operation. Conventional lamps are typically replaced after approximately 6 months of service.

Despite the maintenance advantages, prior art LED devices have not been successful in providing high efficiency solutions which provide compelling economic motivation to replace conventional lighting.

There is a need for higher efficiency LED billboard lighting systems.

2. Prior Art Devices

A common example of prior art lighting for a large 14' by 48' billboard is the use of four metal halide lamp fixtures as shown in FIG. 1. Each lamp is typically 400-500 watts, so that the total energy requirement is 1600 watts or more.

Another prior art device is the Halophane™ fixture. Its distributor reports that two 400 watt lamps may be used to light a billboard.

The Adtech™ Ecotech™ series LED lights reportedly use a total of 624 watts per billboard side.

One aspect of the current invention is the ability to provide effective billboard lighting with approximately 200 total watts per side.

The current invention provides dramatically higher efficiency than prior art devices. This higher efficiency is achieved with less complex devices than prior art LED billboard lighting products, so that the current invention can be sold at prices that approach conventional lighting products. The ability to provide substantially improved energy efficiency, low cost, and long-life LED devices also facilitates the use of solar, wind, or other low energy density power for the devices.

SUMMARY OF INVENTION

The current invention includes the methods of retrofitting existing billboards; providing lighting for new billboards; installing and orienting LED lighting devices; communicating with LED lighting controllers; controlling LED devices.

The current invention includes methods for designing and fabricating LED lighting devices, such as for billboards.

The current invention includes LED lighting devices, such as for billboards.

Some aspects of the design methods include

- LED devices are designed or selected to permit the effective use of a small number of discrete devices, each serving as a very efficient source of light relative to its energy input requirements. Considerations for this LED design or selection include
  - A preferred positioning of the diode(s) in the middle portion of an LED package relative to the package height as illustrated in FIG. 4. This positioning facilitates a more efficient capture and reflection of available light.
  - A preference for a "lens" or diode encasement that
    - Avoids the use of a curved lens which can create non-uniform lighting due to the relative high percentage of light transmitted directly from the diode directly through a curved lens;
    - Provides a fine scattering of light; and
    - Provides a relatively large LED package relative to the diode. This large packaging contributes to a larger light source versus a "point source" LED. A "point source" LED with a curved lens provides a region of high intensity along an axis perpendicular to the lens; and it is not possible to convert this light source to a uniform lighting over a large area. As a consequence of this effect, prior art devices tend to have large numbers of relativley smaller LEDs, and therefore have higher cost, lower efficiency, and still have problems delivering a uniform light pattern for billboards. As described below, an example embodiment of the current invention for a 48 foot wide billboard uses 48 LEDs versus 1200 LEDs for a prior art device.
  - Providing a diffuser having a phosphor diffuser area much larger than the diode cross section. In one example described below, the phosphor area is about 10× larger than the diode area. This large phosphor area permits a more efficient capture of available light from the diode and presents the LED as a much larger area than a point source.
  - In one example, many of these LED design considerations are accomplished by selecting a commercially available LED such as a Citizen Electronics Group Co., LTD. CL-L102 series LED. In other cases, these design methods may be used to optimize LED design for billboard lighting or other applications.
- Optimizing reflection using techniques such as
  - Designing a reflector to provide a uniform asymmetric pattern for a billboard. In one example, most reflected light is directed to a relatively small portion of the target billboard plane, while direct lighting is provided to a relatively large area of the billboard.
  - Maintaining economies of scale by using the same reflector design for various size billboards, including 8 foot high, 10 foot high, and 14 foot high. A common reflector may be provided and positioned at different distances from billboards to achieve the different projection sizes.
  - Providing an adjustable bracket for varying mounting distance and angle; and providing simple and reliable methods for aligning the reflectors (the housings) properly. In one example, this alignment is obtained by using a simple pair of strings from the top and bottom of the billboard to the housing, and aligning reference marks on the housings with the strings.
- Optimizing refraction using techniques such as
  - Providing a first "diffuser clamp" and a second diffuser lens.
  - Using the first diffuser clamp to obtain good thermal contact between the LED and the housing for thermal management; lessening the "harshness" of the LED light source; reflecting or blocking yellow light which is transmitted out the sides of the LED; and providing a top-side heat sink for the LED.
- Optimizing LED device control using techniques

DESCRIPTION OF EMBODIMENT

Billboard Light Replacement Fixture

List of Elements

Figure 1:
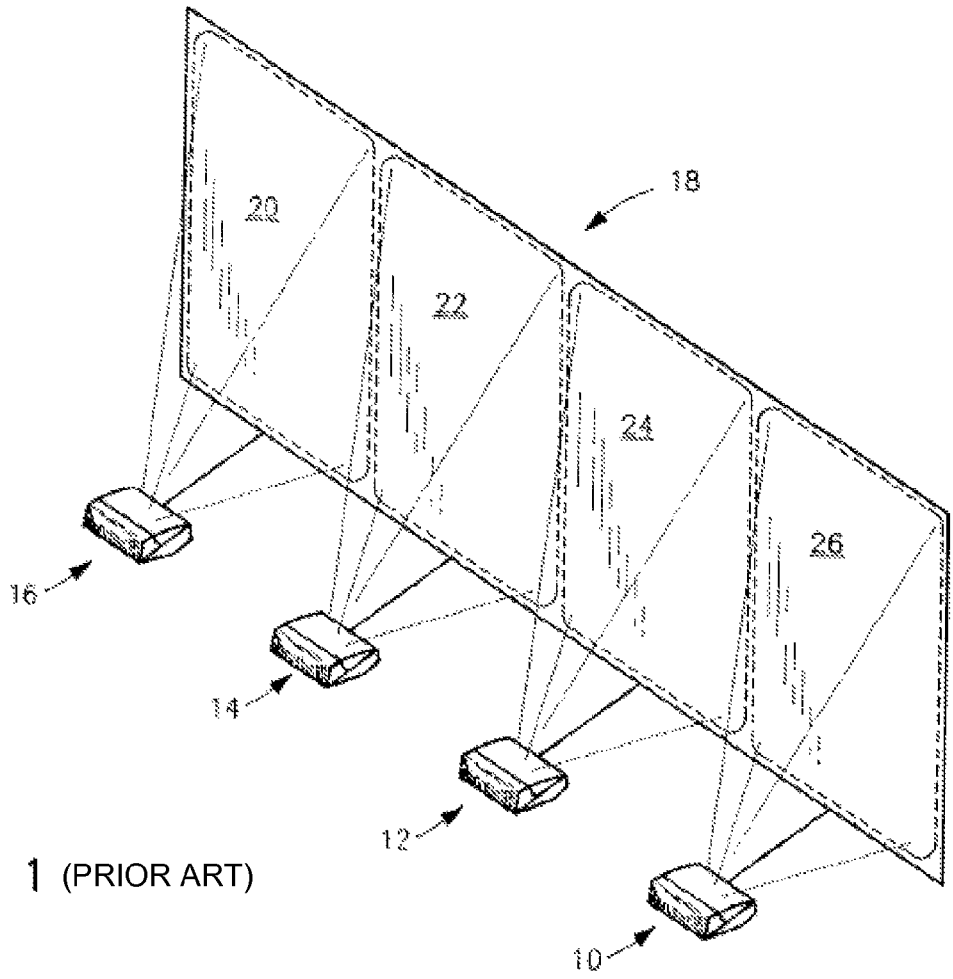
FIG 1 (PRIOR ART)
FIG. 1 is an example of a prior art 4 module lighting system for a billboard.

The following list of elements is provided for convenience.

Lighting module 100
housing 120
reflector holding plate 130
heat sink reflector 150
  reflector extension plate 152
    bent corner of reflector extension plate 154
LED package 200
  Diode 210
  Phosphor diffuser 220
  flat fine diffusing lens 230
diffuser clamp 250
  upward-facing fine scattering pattern 252
  hold down elements 254
diffusing lens 260
  downward-facing fine scattering pattern 262
controller 300
  batteries 310

Advantages of Replacing Fixture Rather than Bulbs

Many players in the LED lighting scene propose and sell Light Bulb, Fluorescent Tube and High Pressure Sodium Fitting Replacements. One embodiment of the current invention is the replacement of the whole fitting as the only way to efficiently disperse the heat generated by the LED lighting arrangement in such a way that the junction temperature remains in the sweet spot during prolonged operation.

The most common billboard lighting arrangement is a 480 Watt High Pressure Sodium Lamp and a special mirror arrangement designed to provide relatively even coverage of the billboard. The efficiency of a HPS arrangement is approximately 56 lumens per watt when the bulb is new and the spectrum often expressed in temperature is around 5500K (bright white). There is always a bright spot in the center as the glass shape of the lamp builds a focusing lens that produces a hot and bright spot in the center of the field the mirror is aimed at.

Instead of making bulb replacements for billboard lighting, this embodiment is for the making of a replacement fixture. This way light output limitations of an LED light can be compensated for by providing an ideal operating environment as described in copending patent applications by applicant (U.S. Patent Application Nos. 61/115,739; 61/115,775; 61/115,790; and 61/149,076 which are incorporate by reference to this specification) and optimal light distribution as well as diffusion to eliminate user aversion against too bright light sources.

One aspect of the current invention is to facilitate fast rollout of more efficient lighting technology, where more efficient is defined as the combination of;

- Power Factor Corrected Lighting Devices—reduce the cost of sub-stations due to lower need, if any, for large or larger capacitors at the sub-station to compensate for bad power factors by the energy users. This is significant as Lighting is a major component of energy usage,
- No need to replace failing or ailing HPS Lamps or fluorescent tubes or their failing ballasts—reduces the waste of glass and copper and iron, rare gases, eliminates the need for safe disposal of mercury laden tubes or bulbs. As long as fluorescent tubes and HPS lamps are the main source of lighting they are being disposed of inadequately and the main source for mercury poisoning of the environment;
- No need to clean diffusers from the inside. Because there is no need to change light bulbs or fluorescent tubes, the diffuser, reflector and LED carrier can be hermetically sealed, so only the outside of the diffuser needs cleaning;
- Diffusing at the LED and diffusing at some distance improves the even distribution of diffuse light over the billboard surface without significant reduction in light output by scattering the light better.
- By adding mirrors for the deflection of light in unwanted areas of the reflector region and directing those light beams to regions of the target area where they can substitute the light intensity a better use of light can be achieved. This further improves the actual light emission in the target areas and compensates for the overall light output from the light emitter;
- Overall weight of an LED fitting is less than or equal to an equivalent conventional HPS or fluorescent light fitting reducing the mechanical and wind load on a billboard structure;
- The lower heat generation will significantly reduce running cost and carbon footprint. The carbon footprint is reduced by approximately 85% compared to HPS Lamps or 15% compared to Fluorescent tubes. Over a 10 year cycle HPS lamps have to be replaced every 6 months and Fluorescent Tubes every 9 months to keep the same high light output while the specific make of LEDs used in this application will retain their full light output (more than 95%) over a 10 year period.

In this embodiment, the whole billboard lighting fixture is replaced. This way the electrician can disconnect the old fitting and re-connect the new fitting. By contrast, in bulb or tube replacement technology, where the ballast has to be removed or at least disabled, fittings must be re-wired and/or receptacles replaced, tube or bulb replacements have to be installed. The following downsides continue to exist with bulb and tube replacement-inadequate cooling and the resulting low energy efficiency; and the need to clean diffusers.

EXAMPLE

First Side Lighting System

In this example, one side of a billboard is illuminated with a first side lighting system comprising four lighting modules 100. The second side of the billboard may be illuminated with a second side lighting system also comprising four lighting modules.

Example Construction of Lighting Module 100 for LED Billboard Replacement Fitting In this example, a high efficiency LED billboard lighting system with four LED modules replaces existing lighting modules. Each lighting module has six heat sink assemblies arranged in two rows. The heat sink assemblies comprise an LED package mounted on a heat sink reflector.

Housing and Reflector Design—Heat Sink Assemblies

Figure 3A:
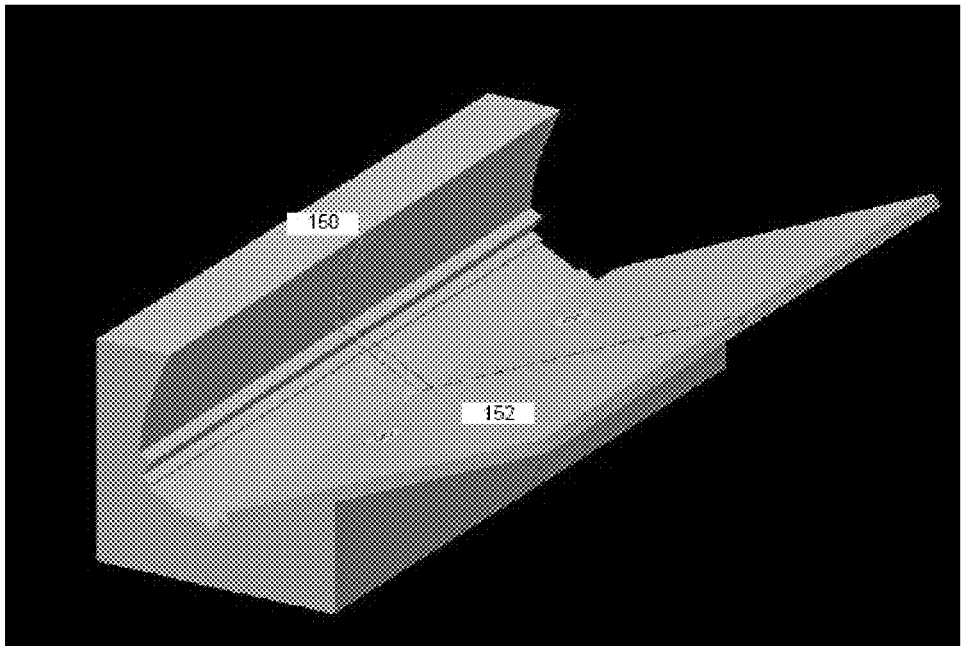
FIG. 3A is a perspective view of a reflector design of one embodiment of the current invention showing a main reflector and an extension plate.

FIG. 3A is a perspective view of a reflector design of one embodiment of the current invention showing a main heat sink reflector 150 and a reflector extension plate 152.

Figure 3B:
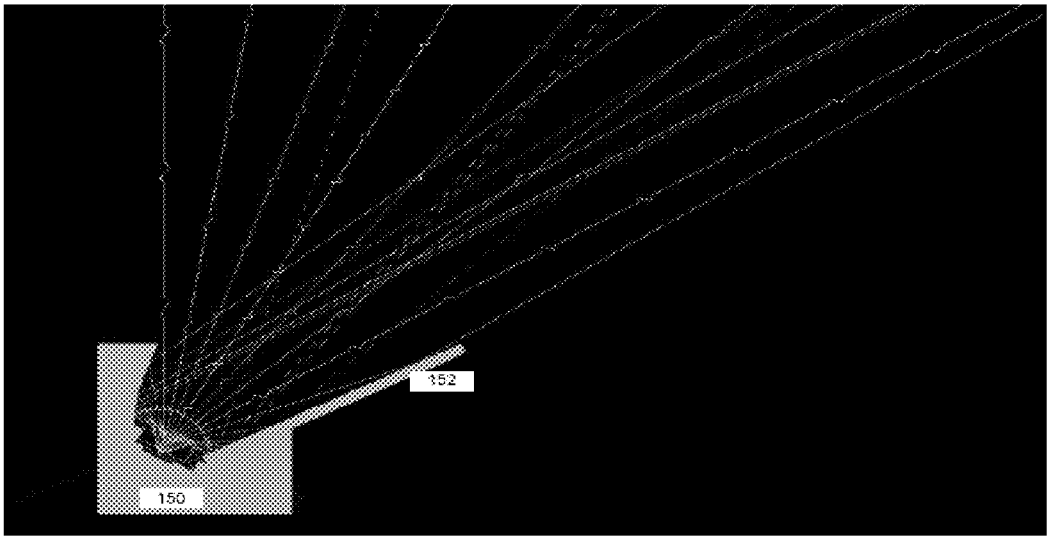
FIG. 3B is a side view of the reflector design of FIG. 3A showing a plurality of representative light rays.

FIG. 3B is a side view of the reflector design of FIG. 3A showing a plurality of representative light rays.

In this embodiment, the general construction is an aluminum or copper, welded, extruded or formed frame housing 120 with either a separate or attached reflector holding plate 130 that acts also as the base to hold the seals, diffuser 260 and reflector 150 in place.

The construction allows for fast assembly and rigid construction, shipping of two units in one container can be achieved without breaking a glass diffuser.

In one example, the reflector is made from either "Formed", "Cut and Bent", "Extruded" or "Cast Aluminum" 3000 or 6000 series for best heat transfer or any other method of producing a suitable shape.

The reflector may also be made from formed copper that has been coated with a highly reflective material such as chrome or high-bright nickel or stuck on glass or plastic mirrors.

Extension Plate

In this embodiment, a reflector extension plate 152 can be attached to the main reflector in order to extend the reflection area.

In this example, the extension plate extends to both sides of the main reflector. The ends of the extensions may be bent, such as at a 45 degree angle, in order to eliminate light overspill from the sides of the billboard.

Alignment Feature

The housing may include reference marks that permit an easy field alignment of the device as described in the installation section below.

LED Package

In this embodiment, the LED packages include a diode and a first refraction element.

In this embodiment, the LEDs are Citizen Electronics Group co., LTD. CL-L102 series LEDs with a 120 degree viewing angle. Each module has tow rows of 3 LEDs for a total of 5 LEDs per module. For 14 foot high billboards, 8 watt LEDs are used; for 10 foot high billboards, 7 watt LEDs are used; and for 8 foot high billboards, 6 watt LEDs are used.

The LEDs provide 140 lumens/watt By contrast, prior art LED lighting may use 40 lumens per watt, or approximately 170 watts for a light module versus about 50 watts for a module of the current invention The LEDs are typically selected or designed considering light output per watt and light output per cost.

Refraction Elements

Figure 4:
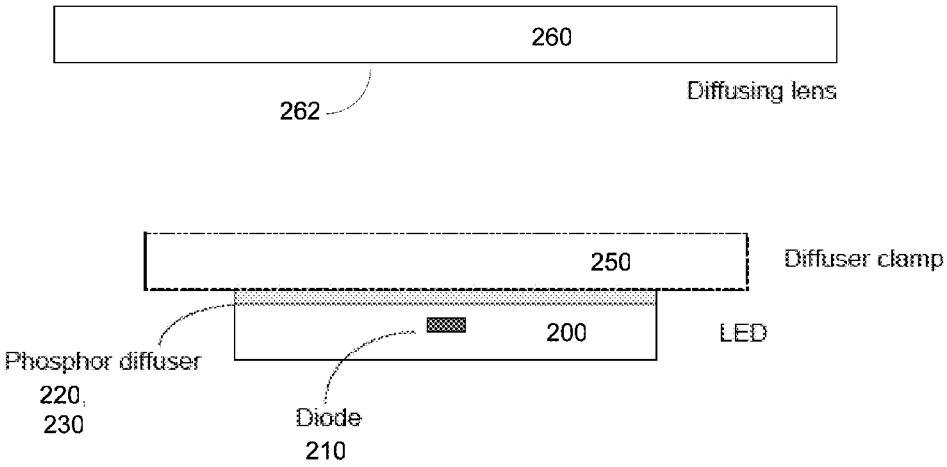
FIG. 4 is a simplified cross section of an example embodiment showing an LED, a diffuser clamp, and a diffusing lens.

FIG. 4 is a simplified cross section of an example embodiment. In this example, each of the 4 lighting modules has 6 LEDS, arranged in two rows. In this embodiment, some aspects of the LED include the placement of the diode relatively high in the LED package, a phosphor diffuser having an area approximately 10× that of the diode, and a flat fine diffusing lens on the LED. Refraction is managed with two refraction elements.

The 6 LEDs per module represents a total of 24 LEDs for the four modules of a 48 foot wide billboard. By contrast, a prior art LED device provides a total of about 1200 LEDs for a 48 foot wide billboard.

Figure 2:
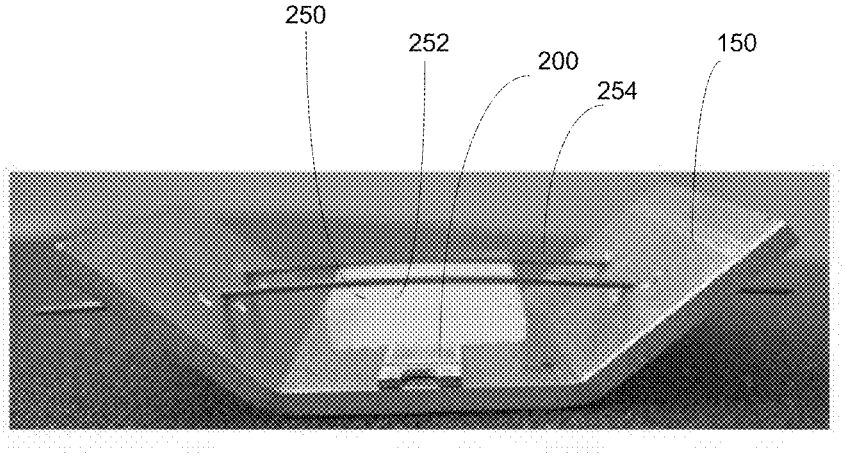
FIG. 2 is a side view of an example diffuser clamp. (Note that this figure shows a symmetric reflector rather than an asymmetric billboard reflector.)

FIG. 2 is a side view of an example diffuser clamp.

The first refraction element is a diffuser clamp 250, such as 3/16 inch Industrex™ glass with an upward-facing fine scattering pattern 252. This diffuser clamp serves several functions including clamping the LED in good thermal contact with the housing for thermal management; lessening the "harshness" of the LED light source; reflecting or blocking yellow light which is transmitted out the sides of the LED; and providing a top-side heat sink for the LED. In this example, the diffuser clamp extends past the LED in order to block the yellow light from the sides of the LED.

The second refraction element is a diffusing lens 260, such as 3/16 inch Industrex™ glass that may have a downward-facing fine scattering pattern 262. Orienting this diffusing lens with the fine scattering pattern facing downward reduces the accumulation of dust on the top of the lens. One function of this lens is to reduce the LED harshness.

Relatively thin refraction elements may be used in order to reduce reflection.

Controller

In this embodiment, a custom controller is used.

The controller can determine approximate dawn to dusk timing without a calendar. In one example, the controller records dusk and dawn for the 3 days prior to the current day, and turns on the LEDs at dusk; turns them off at midnight, and turns them on 2 hours before dawn. Other timing selections may be made.

The controller has a low voltage (48 volt) connector so that it can run on four 12-volt batteries. The controller has a power factor corrected, switch mode Power Supply, where the secondary side can be connected directly to a battery to monitor and charge the battery, and can run directly from the batteries. This design permits more efficient battery management for longer battery life.

In this embodiment, each module has a controller. One controller is configured to be a sensor and can inform (communicate with) the other controllers by wire or wirelessly.

Methods of Installation and Alignment

New or replacement modules are provided to mount on billboards. Alignment marks on the module housing are aligned with strings from the top and bottom of the billboard to quickly establish proper spacing and orientation angle.

Method of Construction

In one example, side panels are prepared with seal and alignment features. An outer heat sink is thermally connected to reflector base. An LED Power Supply is mounted to back of Reflector Base. A Reflector Base/Heat-Sink is provided with LED on Reflector held by Glass-Diffuser and sealed by "Silicon Adhesive Seal" installed. A frame is mounted to the Reflector base.

Communication and Control Methods

An LED controller may communicate by wire or wirelessly with other controllers. This permits a single controller to determine or receive an on/off control signal and communicate with the other controllers.

Design Methods

Some aspects of the design methods include

LED devices are designed or selected to permit the effective use of a small number of discrete devices, each serving as a very efficient source of light relative to its energy input requirements. Considerations for this LED design or selection include A preferred positioning of the diode(s) in the middle portion of an LED package relative to the package height as illustrated in FIG. 4. This positioning facilitates a more efficient capture and reflection of available light.

A preference for a "lens" or die encasement that

Avoids the use of a curved lens which can create non-uniform lighting due to the relative high percentage of light transmitted directly from the diode directly through a curved lens;

Provides a fine scattering of light; and

Provides a relatively large LED package relative to the diode. This large packaging contributes to a larger light source versus a "point source" LED. A "point source" LED with a curved lens provides a region of high intensity along an axis perpendicular to the lens; and it is not possible to convert this light source to a uniform lighting over a large area. As a consequence of this effect, prior art devices tend to have large numbers of relativley smaller LEDs, and therefore have higher cost, lower efficiency, and still have problems delivering a uniform light pattern for billboards. As described below, an example embodiment of the current invention for a 48 foot wide billboard uses 48 LEDs versus 1200 LEDs for a prior art device.

Providing a diffuser having a phosphor diffuser area much larger than the diode cross section. In one example described below, the phosphor area is about 10× larger than the diode area. This large phosphor area permits a more efficient capture of available light from the diode and presents the Led as a much larger area than a point source.

Optimizing reflection using techniques such as

Designing a reflector to provide a uniform asymmetric pattern for a billboard. In one example, most reflected light is directed to a relatively small portion of the target billboard plane, while direct lighting is provided to a relatively large area of the billboard.

Maintaining economies of scale by using the same reflector design for various size billboards, including 8 foot high, 10 foot high, and 14 foot high. A common reflector may be provided and positioned at different distances from billboards to achieve the different projection sizes.

Providing an adjustable bracket for varying mounting distance and angle; and providing simple and reliable methods for aligning the reflectors (the housings) properly. In one example, this alignment is obtained by using a simple pair of strings from the top and bottom of the billboard to the housing, and aligning reference marks on the housings with the strings.

Optimizing refraction using techniques.

Optimizing LED device control.

What is claimed is:

1. A lighting system comprising a first side lighting system comprising a plurality of lighting modules, each lighting module comprising a housing, a plurality of heat sink assemblies, each heat sink assembly comprising a heat sink reflector, wherein said heat sink reflector is designed to provide a uniformly lit surface by an asymmetric pattern, at least one LED package mounted with respect to the heat sink reflector, the LED package comprising a diode, a first refraction element, and a diffusing lens spaced apart from the first refraction element, and a first LED controller.

2. The lighting system of claim 1 further comprising a second side lighting system comprising a plurality of lighting modules, each lighting module comprising a housing, a plurality of heat sink assemblies, each heat sink assembly comprising a heat sink reflector, at least one LED package mounted with respect to the heat sink housing, the LED package comprising a diode, a first refraction element, and a diffusing lens spaced apart from the first refraction element, and a second LED controller.

3. The lighting system of claim 1 further comprising four lighting modules, each lighting module comprising six LED heat sink assemblies, such that the heat sink assemblies are arranged in two rows in the lighting module.

4. The lighting system of claim 1 further comprising a reflector extension plate attached to each heat sink reflector.

5. The lighting system of claim 1 wherein the LED package further comprises a flat fine diffusing lens positioned over the diode.

6. The lighting system of claim 1 wherein the LED package is substantially larger than the diode.

7. The lighting system of claim 1 wherein the LED package comprises a Citizen Electronics Group Co., LTD. CL-L102 series LED with a 120 degree viewing angle.

8. The lighting system of claim 1 wherein the LED package provides approximately provide 140 lumens/watt.

9. The lighting system of claim 1 wherein the first refraction element is a diffuser clamp.

10. The lighting system of claim 9 wherein the diffuser clamp comprises 3/16 inch Industrex® glass with an upward-facing fine scattering pattern.

11. The lighting system of claim 1 wherein the first refraction element has an area approximately 10× of the diode.

12. The lighting system of claim 1 further comprising a plurality of additional controllers, such that each lighting module comprises a controller.

13. The lighting system of claim 1 further comprising a communication link between the first LED controller and one of the plurality of additional controllers.

14. The lighting system of claim 1 further comprising a power supply.

15. The lighting system of claim 14 wherein the power supply comprises a 48 volt battery power supply.

16. A method for providing lighting comprising providing a first side lighting system comprising a plurality of lighting modules, each lighting module comprising a housing, a plurality of heat sink assemblies, each heat sink assembly comprising a heat sink reflector, at least one LED package mounted with respect to the heat sink housing, the LED package comprising a diode, a first refraction element, and a diffusing lens, and a first LED controller and a plurality of other controllers;

improving light capture and reducing the point source properties of each LED package by providing a phosphor diffuser area much larger than the diode cross section;

designing the reflector to provide a uniformly lit surface by an asymmetric pattern; and optimizing refraction by spacing apart the first refraction element from the diffusing lens.

17. The method of claim 16 further comprising communicating from the first LED controller to at least one other controller.

18. The method of claim 16 further comprising optimizing junction temperature by replacing an existing non-LED modules with the first side lighting system of claim 16.

19. The method of claim 16 wherein designing the reflector to provide a uniform asymmetric pattern further comprises providing mirrors to deflect light in unwanted areas of the reflector region and directing those light beams to regions of a billboard.

20. The method of claim 16 further comprising providing, for each module, a power factor corrected, switch mode Power Supply, where the secondary side can be connected directly to a battery to monitor and charge one or more battery, and can run directly from the battery.

* * * * *